US005761922A

United States Patent [19]

Tamai et al.

[11] Patent Number: 5,761,922

[45] Date of Patent: Jun. 9, 1998

[54] LOW TEMPERATURE DISPLAY CASE

[75] Inventors: Hirokuni Tamai, Gunma; Atsushi Todoroki, Gyoda; Hisao Sagara, Gunma; Norikazu Ogushi, Gunma; Yasunari Ishihara, Gunma, all of Japan

[73] Assignee: Sanyo Electric Co. Ltd., Osaka, Japan

[21] Appl. No.: 731,347

[22] Filed: Oct. 11, 1996

[30] Foreign Application Priority Data

Oct. 11, 1995 [JP] Japan ..... 7-289246

[51] Int. Cl.[6] ..... A47F 3/04

[52] U.S. Cl. ..... 62/256; 62/285

[58] Field of Search ..... 62/256, 285, 288, 62/291, 515

[56] References Cited

U.S. PATENT DOCUMENTS

| | | | |
|---|---|---|---|
| 2,513,675 | 7/1950 | Quillen | 62/256 |
| 3,182,466 | 5/1965 | Beckwith | 62/256 |
| 4,117,698 | 10/1978 | Vogel | 62/256 |
| 4,145,893 | 3/1979 | Vogel | 62/256 |
| 4,690,209 | 9/1987 | Martin | 62/515 |
| 5,475,988 | 12/1995 | McGovern | 62/256 |

FOREIGN PATENT DOCUMENTS

| | | | |
|---|---|---|---|
| 1197105 | 7/1965 | Germany | 62/256 |

*Primary Examiner*—William E. Tapolcai
*Attorney, Agent, or Firm*—Darby & Darby

[57] ABSTRACT

Provided is a low temperature display case, which comprises: a duct that is so formed that it communicates with a rear and a lower portion of a storage chamber having an opening at the front, an evaporator that is provided upright in a duct at a rear location, a blower for discharging, from an upper edge of the opening of the storage chamber, air that is cooled at the evaporator by heat exchange, a drain pan that is located at a bottom level of the duct and that is inclined downward toward a drain hole, defrosting heaters that are provided in a lower portion of the duct and that are located forward of a position under the evaporator, and a sharply sloped portion that is provided on the drain pan below the evaporator and that is inclined at a greater angle toward the drain hole than is the drain pan; wherein to defrost the evaporator a refrigerant at a high temperature is fed into the evaporator, and heat is generated by the defrosting heaters.

4 Claims, 8 Drawing Sheets

LOW TEMPERATURE DISPLAY CASE

BACKGROUND OF THE INVENTION

Field of the Invention

The present invention relates to a low temperature display case wherein are formed ducts, which communicate with the rear and the lower side of a storage chamber that is open to the front, whereby cool air, which is obtained by heat exchange in an evaporator that is provided upright in a duct at the rear, is discharged by a blower from openings at the upper edge of the storage chamber.

Conventionally, as is described in, for example, Japanese Examined Patent Publication No. Hei 3-45307 (F23D23/08), a low temperature display case of the above described type is designed with a division wall located on the internal face of a substantially C-shaped heat insulation wall and a deck pan located at the bottom to define a storage chamber and a duct, and an evaporator and a blower are provided in the duct. With this design, air cooled in the duct is circulated through the storage chamber.

The structure of a conventional low temperature display case 100 will now be described while referring to FIG. 8. The low temperature display case 100 is constructed with a substantially C-shaped heat insulation division wall 103 mounted, with an intervening space, inside a heat insulation wall 102, which is also substantially C shaped. A partition panel 104 is attached, with an intervening space, at its rear side to the upper and the lower internal side of the heat insulation division wall 103. Deck struts 106 are provided on each side and in the center of the partition panel 104.

The lower ends of the deck struts 106 and of the partition panel 104 are secured either directly or via another member to a metal fitting 107, the ends of which are fixed to frames (not shown) on either side of the heat insulation wall 102. In front of the lower portion of the partition panel 104, a deck pan 108 is provided, with an intervening space, above a bottom wall 103A of the heat insulation division wall 103. A storage chamber 109, which is open to the front, is defined by an area enclosed by the partition panel 104 and the deck pan 108. An outer duct 111 that is formed between the heat insulation wall 102 and the heat insulation division wall 103, and an inner duct 112 that is formed between the heat insulation division wall 103 and the partition panel 104 and the deck pan 108, communicate with the upper, the rear and the lower portions of the storage chamber 109.

An evaporator 113 that is included in a cooler is provided upright at the rear inside the inner duct 112, with the front lower end of its tube sheet (not shown) fixed to the metal fitting 107. A suction blower 114 (for an inner duct) is provided below the deck pan 108 in the front internal portion of the inner duct 112, and a suction blower 116 (for an outer duct) is provided in the front internal portion of the outer duct 111, which is located below the inner duct 112.

The top surface of the bottom wall 103A, of the heat insulation division wall 103, inclines downward at an angle of 4 degrees, for example, toward a drain hole 117, which is located beneath the blower 114. The top face of the bottom wall 103A, therefore, serves as a drain pan 118, and drain pan heaters (electric heaters) 119 for the drain pan 118 are provided near the drain hole 117. The drain hole 117 communicates with the outer duct 111, and defrosting heaters (electric heaters) 122 and an attachment plate 121 are provided inside the inner duct 112 at the upper rear portion of the drain pan 118.

When during defrosting water from the evaporator 113 contacts the defrosting heaters 122, the amount of heat generated is considerably reduced, and steam may be produced. Therefore, the defrosting heaters 122 are located forward of the evaporator 113 and under the metal fitting 107, so that during defrosting, water falling from the evaporator 113 will not fall directly on the heaters 122.

The upper ends of the inner and outer ducts 112 and 111 communicate respectively with an inner discharge opening 124 and an outer discharge opening 126, which are positioned near the upper edge of the opening of the storage chamber 109. An inner intake opening 127 and an outer intake opening 128 are formed at the lower edge of the opening of the storage chamber 109, and from the front the opening 127 is located behind the opening 128. The inner intake opening 127 communicates with the inner duct 112, and the outer intake opening 128 communicates with the outer duct 111.

In the storage chamber 109, decks 129, on which frozen foods, such as ice cream can be displayed, are supported as a series of steps by the deck struts 106. With this structure, when the cooling device is activated to drive the blowers 114 and 116, air is drawn in by the blower 114 and is driven toward the evaporator 113. The air that passes through the evaporator 113 and is cooled by heat exchange rises along the inner duct 112 and is expelled toward the front opening of the storage chamber 109 from the inner discharge opening 124, which is formed at the upper edge of the front opening of the storage chamber 109. As a result, a curtain of cool air covers the front opening of the storage chamber 109 while the cool air circulates through the storage chamber 109 to maintain therein at a predetermined refrigerating temperature.

The air that is driven by the blower 116 rises along the outer duct layer 111 and is expelled toward the front opening of the storage chamber 109 from the outer discharge opening 126, which is formed at the upper edge of the opening of the storage chamber 109. As a result, a protective air curtain is formed outside the cool air curtain.

During the cooling operation, frost builds up on the evaporator 113 and around the periphery of its inner duct 112. Therefore, while the blowers 114 and 116 are being operated, the defrosting heaters 122 are periodically rendered conductive, and warm air from the blower 114 is conveyed to the evaporator 113 to heat it. At the same time, refrigerant gas is discharged at a high temperature from a compressor (not shown) of the cooling device and flows through the pipe in the evaporator 113 to heat it from the inside. In this manner, defrosting of the evaporator 113 is performed.

During the defrosting operation, water falls from the evaporator 113 into the inclined drain pan 118 and flows toward the drain hole 117, where it is discharged to the exterior. Since the drain pan heaters 118 are also conductive during the defrosting, the water that falls from the evaporator 113 into the drain pan 118 is prevented from being refrozen, and thawing of the frost and ice formed in the inner duct layer 112 occurs.

The defrosting of the evaporator 113 is completed when the temperature of the evaporator 113 has reached a specific defrosting end temperature, e.g., +10° C. When, as is described above, the defrosting of the evaporator 113 and its peripheral area is performed by the circulation of refrigerant gas at a high temperature and the warm air from the defrosting heaters 122, a period required for defrosting can be reduced from the conventional 25 minutes to 15 minutes.

In other words, because the defrosting time can be reduced, thawing of goods, such as ice cream, that are displayed in the storage chamber 109 can be prevented, and deterioration of the quality of the goods can be inhibited.

When defrosting is performed for a shorter time, however, frost will remain in those locations that are hard for the high temperature refrigerant gas and the heat from the defrosting heaters 122 to reach. For example, cold water and ice fall on that portion of the drain pan 118 that is below the evaporator 113, and since that location is relatively distant from both the drain pan heaters 119 and the defrosting heaters 122, the temperature there rises only to 0° C.

In addition, since the inclination angle of the drain pan 118 is small, e.g., four degrees, and water dose not drain away well and tends to remain at that location, hard frost builds up on the portion of the drain pan 118 that lies below the evaporator 113 and impedes the circulation of cool air along the inner duct layer 112.

Further, since metal fitting 107 that contacts the evaporator 113 is greatly affected by the cooling provided by the evaporator 113, frost tends to build up on it, and water that falls on it from the top of the evaporator 113 tends to remain there. And as the metal fitting 107 is located apart from the pipe of the evaporator 113 and the defrosting heaters 122, when the defrosting time is reduced, as is described above, incomplete defrosting will occur at the metal fitting 107, and residual frost will build up thereon that can break the pipe in the evaporator 113.

SUMMARY OF THE INVENTION

To resolve the conventional technical shortcomings, it is one object of the present invention to provide a low temperature display case in which incomplete defrosting is effectively prevented while the defrosting time for evaporator is reduced.

According to the present invention, provided is a low temperature display case, which comprises:

- a duct that is so formed that it communicates with a rear and a lower portion of a storage chamber having an opening at the front,
- an evaporator that is provided upright in a duct at a rear location,
- a blower for discharging, from an upper edge of the opening of the storage chamber, air that is cooled at the evaporator by heat exchange,
- a drain guide face that is located at a bottom level of the duct and that is inclined downward toward a drain hole;
- defrosting heaters that are provided in a lower portion of the duct and that are located forward of a position under the evaporator, and
- a sharply sloped portion that is provided on the drain guide face below the evaporator and that is inclined at a greater angle toward the drain hole than is the drain guide face;
- wherein to defrost the evaporator a refrigerant at a high temperature is fed into the evaporator, and heat is generated by the defrosting heaters.

According to the present invention, in a low temperature display case, a pipe along which the high temperature refrigerant circulates is attached to the sharply sloped portion.

Further, according to the present invention, in a low temperature display case, one part of the defrosting heaters is located close to a position where incomplete defrosting tends to occur.

In addition, according to the present invention, in a low temperature display case, a tube sheet for the evaporator is made of a metal having high thermal conductivity.

According to the present invention, in a low temperature display case, a metal strut fitting, which is fixed to front lower ends of the tube sheet of the evaporator, is made of a metal having high thermal conductivity.

According to the present invention, in a low temperature display case, one part of the defrosting heaters is located near the metal strut fitting.

DETAILED DESCRIPTION OF THE PREFERRED EMBODIMENTS

Figure 1:
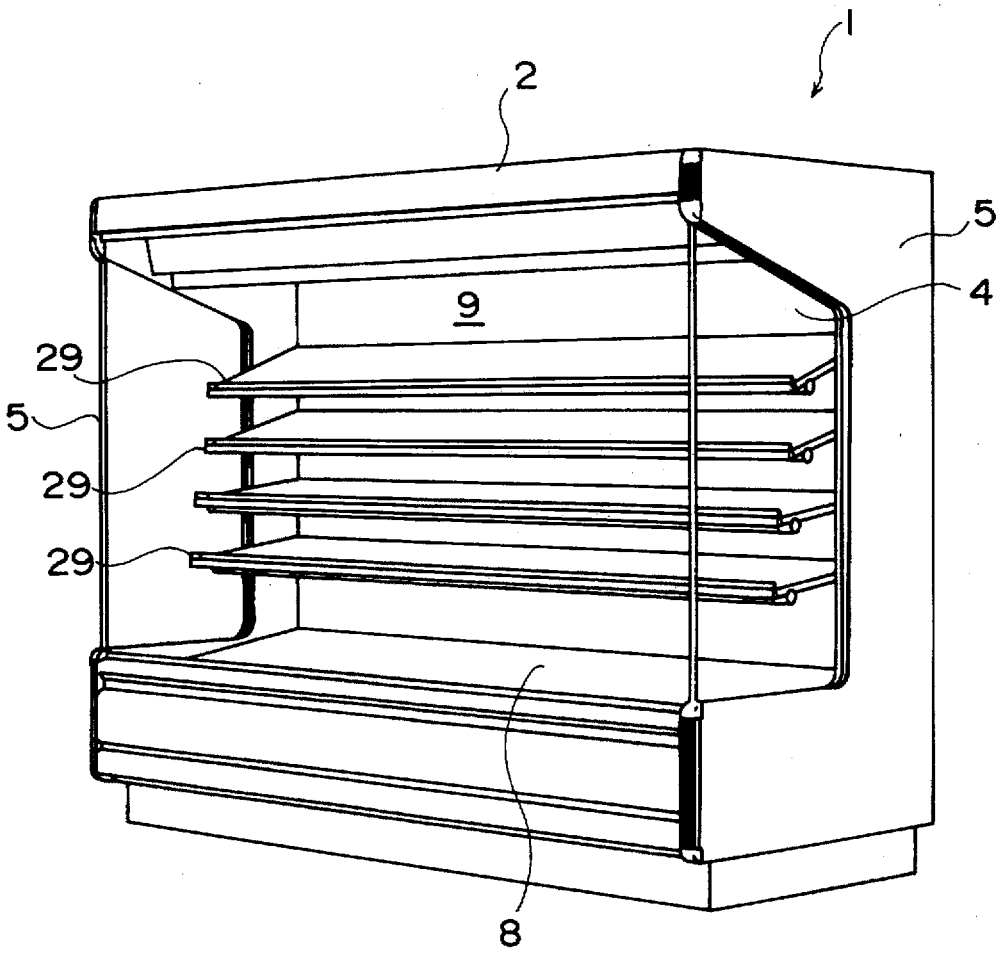
FIG. 1 is a perspective view of a low temperature display case according to one embodiment of the present invention.
Figure 2:
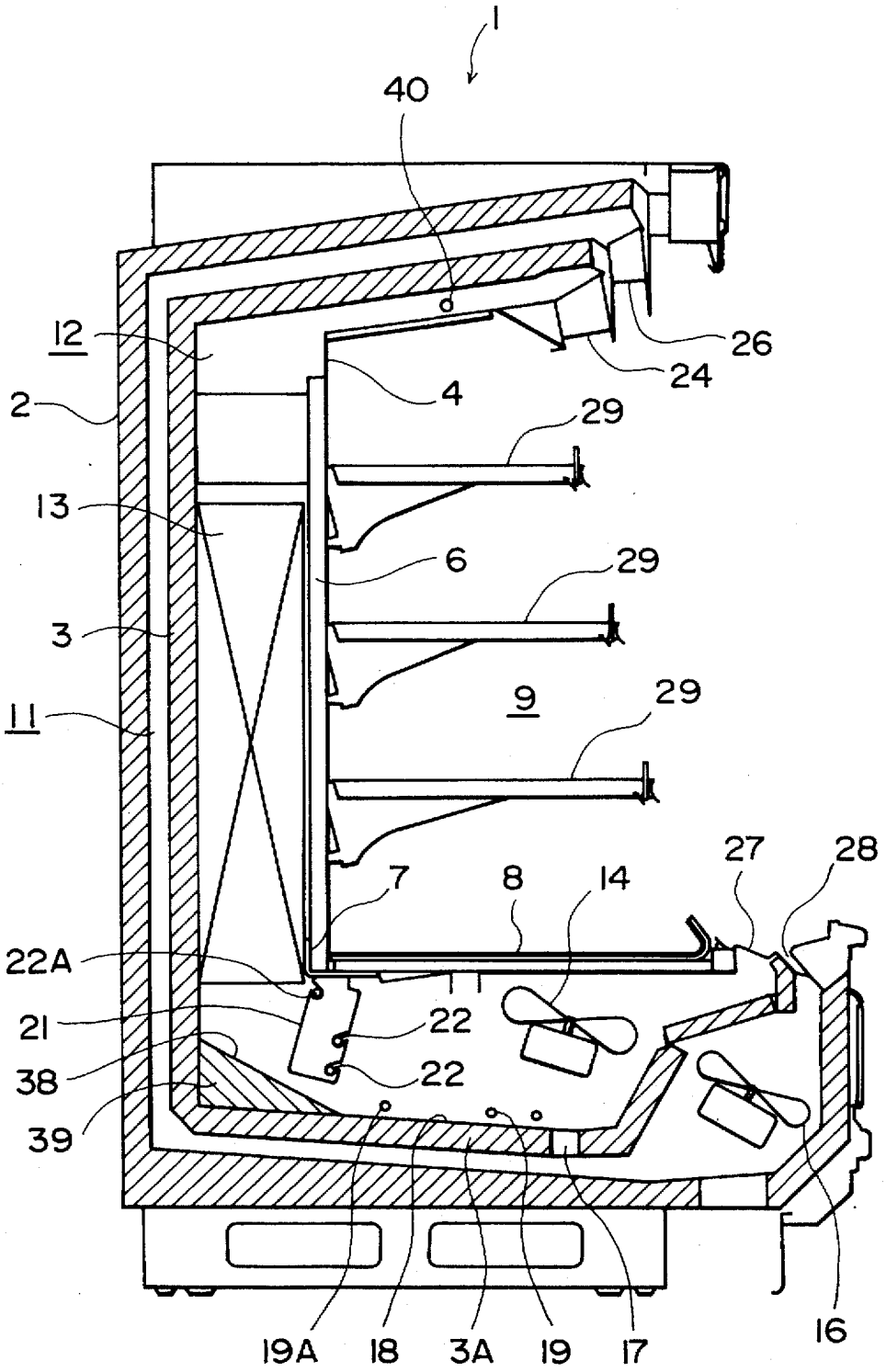
FIG. 2 is a vertical cross sectional side view of the low temperature display case according to the present invention.
Figure 3:
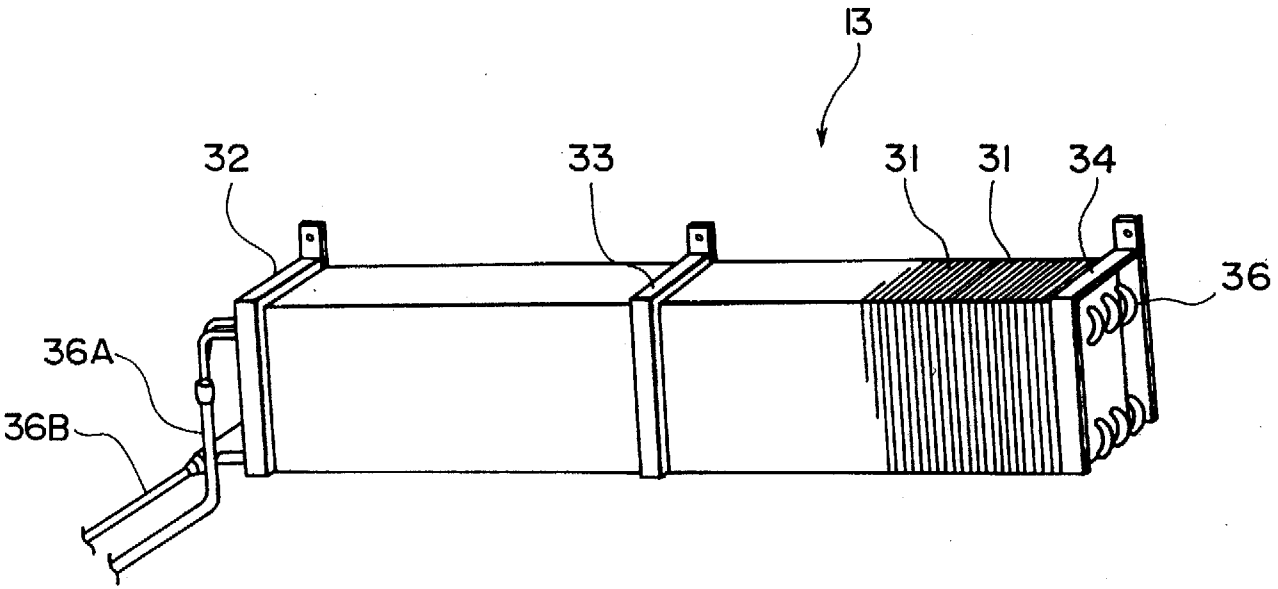
FIG. 3 is a perspective view of an evaporator in the low temperature display case according to the present invention.
Figure 4:
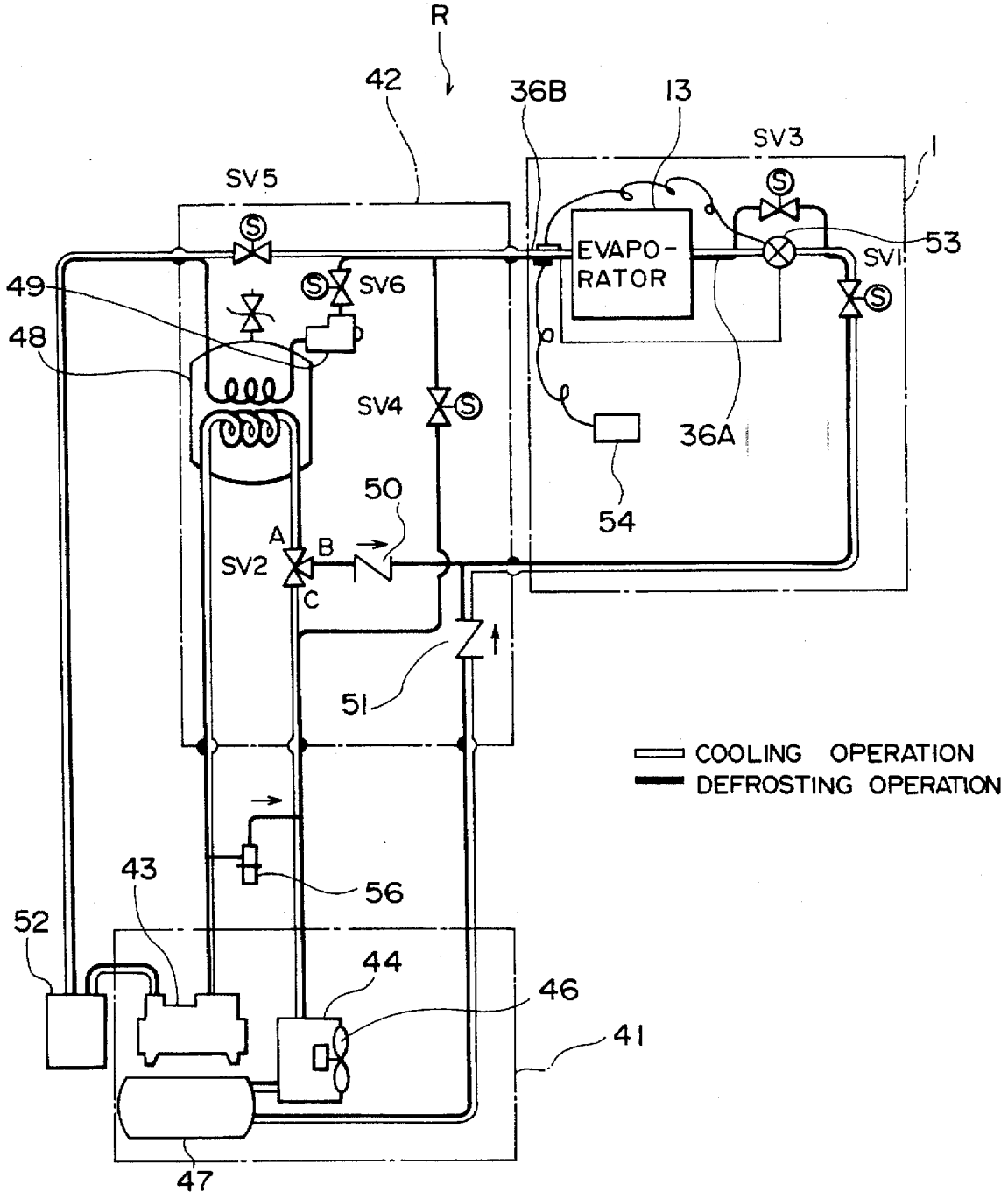
FIG. 4 is a refrigerant circuit diagram of a cooling device for cooling the low temperature display case of the present invention.

The preferred embodiments of the present invention will now be described in detail while referring to the accompanying drawings. FIG. 1 is a perspective view of a low temperature display case 1 according to the present invention; FIG. 2 is a vertical cross sectional side view of the low temperature display case 1; FIG. 3 is a perspective view of an evaporator 13; and FIG. 4 is a refrigerant circuit diagram for a cooling device R for cooling the low temperature display case 1.

The low temperature display case 1 of the present invention is a refrigerating openfront display case that is installed in a store, such as a supermarket or a convenience store, to display chilled confections, such as ice cream, that are for sale. The low temperature display case 1 has a substantially C shaped heat insulation wall 2, and side plates 5 that are attached to both sides of the insulation wall 2. Heat insulation division wall 3, which is substantially C shaped, is so mounted inside the heat insulation wall 2 that there is an intervening space between them. A partition panel 4 is provided inside the upper portion of the heat insulation division wall 3 and extends outward, describing an intervening space. Deck struts 6 are provided at both ends and in the center of the partition panel 4.

The lower ends of the deck struts 6 and of the partition panel 4 are secured either directly or via another member to a metal fitting 7, the ends of which are fixed to frames (not shown) on either side of the heat insulation wall 2. In front of the lower portion of the partition panel 4, a deck pan 8 is provided, with an intervening space, above a bottom wall 3A of the heat insulation division wall 3. A storage chamber 9, which is open to the front, is defined by an area enclosed by the partition panel 4 and the deck pan 8. An outer duct 11 that is formed between the heat insulation wall 2 and the heat insulation division wall 3, and an inner duct 12 that is formed between the heat insulation division wall 3 and the partition panel 4 and the deck pan 8, communicate with the upper, the rear and the lower portions of the storage chamber 9.

An evaporator 13 that is included in a cooling device is provided upright at the rear inside the inner duct 12. As is shown in FIG. 3, the evaporator 13 comprises a plurality of aluminum heat exchange fins 31, tube sheets 32, 33 and 34, which are located at the center and the sides of the heat exchange fins 31; and a sinuously shaped refrigerant pipe 36 that is passed through the tube sheets 32, 33 and 34. The refrigerant pipe 36 has a refrigerant inlet 36A and a refrigerant outlet 36B at its left end near the tube sheet 32.

The center tube sheet 33 and the right end tube sheet 34, both of which are located away from the refrigerant inlet 36A, are made of an aluminum alloy that is a metal having high thermal conductivity. The tube sheet 32 at the left end of the refrigerant pipe 36 is made of galvanized steel or stainless steel, as is a conventional one. This is because brazing is used to connect bent pipes to the refrigerant inlet and outlet 36A and 36B, and the tube sheet would melt if it were formed of aluminum.

The front lower ends of the tube sheets 32, 33 and 34 of the evaporator 13 are fixed to the metal fitting 7. The metal fitting 7 is also made of an aluminum alloy that is a metal having high thermal conductivity, and has a plurality of holes are formed in it. A suction blower 14 (for an inner duct) is provided below the deck pan 108 in the front internal portion of the inner duct 12, and a suction blower 16 (for an outer duct) is provided in the front internal portion of the outer duct 11, which at that point is located below the inner duct 12.

The top surface of the bottom wall 3A, of the heat insulation division wall 3, inclines downward at an angle of 4 degrees, for example, toward a drain hole 17, which is located beneath the blower 14. The top face of the bottom wall 3A, therefore, serves as a drain pan 18, which is a drain guide face, and drain pan heaters (electric heaters) 19 for the drain pan 18 are provided near the drain hole 17, which communicates with the outer duct 11. Defrosting heaters (electric heaters) 22 and an attachment plate 21 are provided inside the inner duct 12 at the upper rear portion of the drain pan 18.

When, during the defrosting operation, water from the evaporator 13 contacts the defrosting heaters 22, the amount of heat generated is considerably reduced, and steam may be produced. Therefore, the defrosting heaters 22 are located forward of the evaporator 13 and under the metal fitting 7, so that during defrosting, water falling from the evaporator 13 will not fall directly onto the heaters 22. A part 22A, one of the defrosting heaters 22, is located near the metal fitting 7.

A slope member 38 is provided as an inclined portion on the drain pan 18 at a position that is directly beneath the evaporator 13. The slope member 38 is made of stainless steel, and its surface is inclined downward toward the drain hole 17 at an inclination angle that is greater than that of the drain pan 18. The slope member 38 is mounted on, and extends from one side to the other of the drain pan 18. With this arrangement, the surface of the slope member 38 is positioned near the defrosting heaters 22.

Although the inclination portion is made of an independent slope member 38 in this embodiment, it may be formed as an integral part of the heat insulation division wall 3.

Further, heat insulation material 39, foamed styrol, is used to fill the slope member 38 (adjacent to the heat insulation division wall 3), and a part 19A, one of the drain pan heaters 19, is located near the slope member 38.

The upper ends of the inner and outer ducts 12 and 11 communicate respectively with an inner discharge opening 24 and an outer discharge opening 26, which are positioned near the upper edge of the open side of the storage chamber 9. An inner intake opening 27 and an outer intake opening 28 are formed at the lower edge of the open side of the storage chamber 9. From the front, the inner intake opening 27 is located behind the outer intake opening 28. The inner intake opening 27 communicates with the inner duct 12, and the outer intake opening 28 communicates with the outer duct 11.

A defrost recovery temperature sensor 40 for the defrosting heaters 22 is provided at the upper portion of the inner duct 12 (upstream of the inner discharge opening 24). Decks 29 are supported by the strut 6 as a series of steps, and frozen foods, such as ice cream, are displayed on the decks 29.

In a refrigerant circuit shown in FIG. 4, a cooling device R comprises a condensing unit 41; a circuit for the low temperature display case 1; a hot gas (high temperature refrigerant) defrosting circuit (hereinafter referred to as a defrost controller) 42; an accumulator 52; and an ejection pressure adjustment valve 56.

The condensing unit 41 includes a compressor 43; a condenser 44; a blower 46 for a condenser; and a fluid reservoir 47. The circuit for the display case 1 includes the above described evaporator 13; an expansion valve 53; solenoid valves SV1 and SV3; and a defrost recovery temperature sensor 54 for the defrost controller 42.

The defrost controller 42 has a heat storage tank 38; an intake pressure adjustment valve 49; a three-way valve SV2; solenoid valves SV5, SV6 and SV4; and check valves 50 and 51. The discharge side of the compressor 43 communicates with the heat storage tank 48 and is connected to the inlet (A) of the three-way valve SV2. The outlet (C) of the three-way valve SV2 is connected to the condenser 44, which communicates with the fluid reservoir 47.

The fluid reservoir 47 is connected to the solenoid valve SV1 via the check valve 51 and a high pressure refrigerant pipe 60. The solenoid valve SV1 is connected to the refrigerant inlet 36A of the evaporator 13 via the expansion valve 53. The heat sensing portion of the expansion valve 53 is attached to the refrigerant outlet 36B of the evaporator 13, and the solenoid valve SV3 is connected in parallel so as to short circuit the expansion valve 53. The defrost recovery temperature sensor 54 is attached to the refrigerant outlet 36B of the refrigerant pipe 36 for the evaporator 13.

The refrigerant outlet 36B of the evaporator 13 is connected to the intake pressure adjustment valve 49 via the solenoid valve SV6, and the pipe from the intake pressure adjustment valve 49 is passed through the heat storage tank 48 and is connected to the accumulator 52. The accumulator 52 is connected to the intake side of the compressor 43.

The solenoid valve SV5 short-circuits the solenoid valve SV6, the intake pressure adjustment valve 49, and the heat storage tank 48. The outlet (B) of the three-way valve SV2 is connected via the check valve 50 to the high pressure refrigerant pipe 60 on the outlet side of the check valve 51. Further, the outlet (C) of the threeway valve SV2 and the inlet of the solenoid valve SV6 communicate with each other via the solenoid valve SV4. In addition, the ejection pressure adjustment valve 56 is connected between the discharge side of the compressor 43 and the outlet (C) of the three-way valve SV2.

Figure 5:
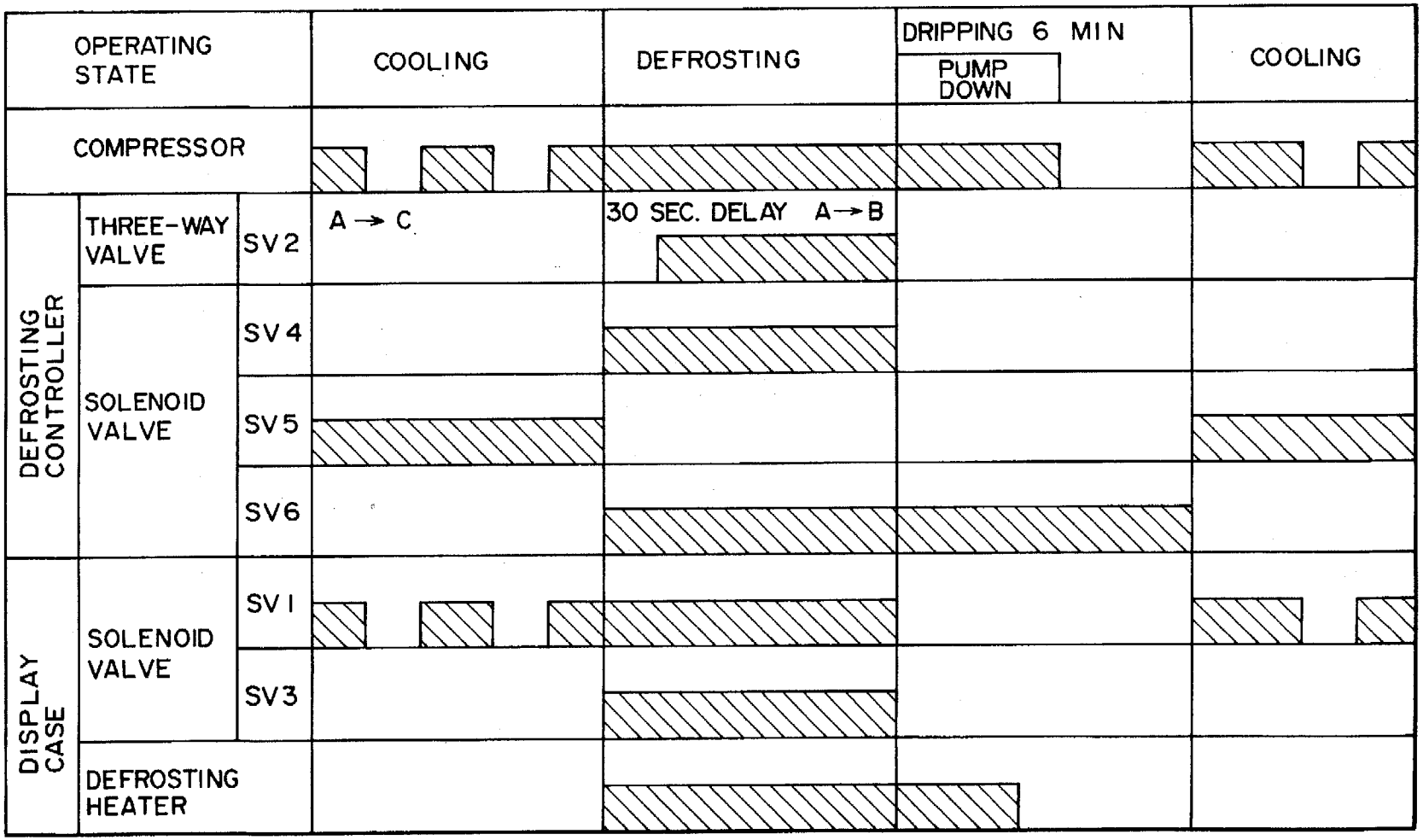
FIG. 5 is a timing chart for explaining the operation of the cooling device, including the low temperature display case of the present invention.

An explanation will now be given for the operations performed by the thus arranged cooling device R, including the low temperature display case 1, while referring to the timing chart in FIG. 5. During the cooling operation, a controller (not shown) sets a flow path across the threeway valve SV2 from A to C, and the solenoid valves SV4, SV6 and SV3 are closed. The solenoid valve SV5 is opened, and when the temperature in the storage chamber 9 in the low temperature display case 1 (or the discharged cool air temperature) becomes high, the solenoid valve SV1 is opened.

Under these conditions, when the compressor 43 is activated to drive the blowers 14, 16 and 46, refrigerant gas at a high temperature and under high pressure from the compressor 43 is passed through the heat storage tank 48 and flows via the three-way valve SV2 to the condenser 44 along pipes represented in FIG. 4 by open parallel lines. The refrigerant is cooled by the blower 46 and the heat is released, and as a result, the refrigerant gas is condensed and liquefied. The refrigerant that has been condensed by the condenser 44 is separated from uncondensed refrigerant gas in the fluid reservoir 47, and only liquid refrigerant is fed through the check valve 51, the high pressure refrigerant pipe 60, and the solenoid valve SV1 to the expansion valve 53.

When the liquid refrigerant reaches and passed through the expansion valve 53, the pressure on it is reduced, and it flows through the refrigerant pipe 36 to the evaporator 13 where it is vaporized and cooling function is performed. The air that is drawn in by the blower 14 is impelled toward the evaporator 13. The air that is cooled by heat exchange while passing through the evaporator 13, and rises along the inner duct 12 until it is discharged, toward the front opening of the storage chamber 9, from the inner discharge opening 24, which is formed at the upper edge of the front opening. As a result, a curtain of cooled air covers the front opening of the storage camber 9, while part of the cooled air circulates through the storage chamber 9 and cools that area.

The air that is drawn in by the blower 16 rises along the outer duct 11, and is discharged, toward the front opening of the storage chamber 9, from the outer discharge opening 26, which is formed at the upper edge of the front opening. Thus, a protective air curtain is formed outside the curtain of cooled air.

The refrigerant is discharged from the refrigerant outlet 36B of the evaporator 13, and flows through the solenoid valve SV5 to the accumulator 52. In the accumulator 52, unvaporized liquid refrigerant is separated from the refrigerant in the gaseous form, and only refrigerant in the gaseous form is fed into the compressor 43.

When the temperature in the storage chamber 9 has fallen to, for example, −21° C. during the cooling operation, the controller closes the solenoid valve SV1 in accordance with the output of a temperature sensor (not shown). Since the flow of the refrigerant to the evaporator 13 is interrupted, the cooling function performed by the evaporator 13 is halted. The intake pressure at the compressor 43 is thereafter reduced and the compressor 43 is halted by a low pressure switch (not shown).

When the temperature in the storage chamber 9 has risen to, for example, −19° C., the controller opens the solenoid valve SV1. Accordingly, the intake pressure at the compressor 43, the compressor 43 is activated, and the cooling cycle is begun. By repeating the above process, on average, the storage chamber 9 is maintained at a refrigerating temperature of −20° C.

During the cooling operation, frost builds up on the evaporator 13 and in the inner duct 12. To dispel this frost, while the blowers 14 and 16 are driven, the controller periodically renders the defrosting heaters 22 and the drain pan heater 19A conductive. The evaporator 13 is heated by warm air that is blown across it by the blower 14, and the drain pan 18 is also heated. When the defrosting operation is begun, the solenoid valves SV1, SV4, SV6 and SV3 are opened and the solenoid valve SV5 is closed.

During the period when the pressure in the evaporator 13 is brought low by opening the solenoid valve SV4, refrigerant at a high temperature flows from the condenser 44 to the evaporator 13. After a time delay of 30 seconds following the start of the defrosting operation, the controller switches the three-way valve SV2 so that the flow path is from A to B.

Consequently, refrigerant gas that is discharged at a high temperature and under high pressure from the compressor 43 is passed through the heat storage tank 48, the three-way valve SV2, the check valve 51, the high pressure refrigerant pipe 60 and the solenoid valves SV1 and SV3, bypasses the expansion valve 53, and enters the evaporator 13 through the refrigerant inlet 36A.

As a consequence of the inflow of the high temperature refrigerant, the evaporator 13 is heated from the inside, and the frost is thawed by warm air from the defrosting heaters 22. The evaporator 13, therefore, is gradually defrosted. The refrigerant that has heated the evaporator 13 and has been discharged form the refrigerant outlet 36B of the evaporator 13 is fed through the solenoid valve sV6 to the intake pressure adjustment valve 49. The pressure on the refrigerant is adjusted, and the refrigerant is thereafter vaporized in the heat storage tank 48 and flows to the accumulator 52. Unvaporized liquid refrigerant is separated in the same manner as is described above, and only refrigerant in the gaseous form is drawn in by the compressor 43.

Although during the defrosting, water that falls from the evaporator 13 and ice are present on the surface of the slope member 38, the inclination of the slope member 38 is so sharp that the water flows smoothly toward the drain hole 17 in the drain pan 18 and is discharged to the exterior. Since the surface of the slope member 38 is located near the defrosting heaters 22, the temperature at the surface rises until it is 0° C. or higher. In addition, since the part 19A, one of the drain pan heaters 19, is also located near the slope member 38, the refreezing of the water that is produced when frost is thawed can be inhibited in the inner duct 12 below the evaporator 13, and incomplete defrosting can therefore be prevented.

Since the metal fitting 7 is fixed to the tube sheets 32, 33 and 34 of the evaporator 13, it is strongly affected by the cooling function of the evaporator 13. As a result, frost tends to build up on the metal fitting 7, and water that falls from the top of the evaporator 13 tends to be retained there.

However, in the present invention, since the tube sheets 33 and 34 of the evaporator 13 are made of an aluminum alloy, heat is smoothly transmitted via the refrigerant pipe 36 to the metal fitting 7. And since the metal fitting 7 is also formed of an aluminum alloy and is positioned near the defrosting heater 22A, the metal fitting is adequately heated.

At the metal fitting 7, where residual frost tends to accumulate, the frost is rapidly thawed, and as a plurality of holes are formed in the metal fitting 7, water also falls smoothly. The problem posed by the incomplete defrosting of the metal fitting 7 is resolved, and the danger that the refrigerant pipe 36 may be broken is eliminated. Although the tube sheet 32 on the refrigerant inlet 36A is not formed of an aluminum alloy, there is abundant heat at that point because refrigerant at a high temperature flows in through the inlet 36A and prevents the occurrence of incomplete defrosting.

Further, as is described above, since the drain pan heaters 19 are also rendered conductive during the defrosting, water that falls on the drain pan 18 can be prevented from refreezing, and frost and ice on other portions in the inner duct can be thawed.

When six to eight minutes have elapsed following the beginning of the defrosting operation, the defrosting of the evaporator 13 is terminated, and the temperature of the outlet 36B is raised to, for example, +10° C. When that is detected by the defrost recovery temperature sensor 54, the controller terminates the defrosting operation, begins a 6minute dripping operation whereby the threeway SV2 is switched so that the flow path is from A to C, the solenoid valves SV4, SV5, SV3 and SV1 are closed, and the collection of refrigerant in the evaporator 13 is begun by beginning a pumping down operation.

The air temperature in the inner duct 12 does not rise to +10° C. when the temperature at the outlet 36B of the evaporator 13 is raised to +10° C. Based on the defrost recovery temperature sensor 40, the controller maintains the defrosting heaters 22 in the conductive state until the air temperature in the inner duct 12 rises to, for example, +10° C. Therefore, even after the defrosting operation is terminated, the defrosting heaters 22 are continuously generating heat.

On the other hand, the temperature in the evaporator 14 is reduced at the start of the pumping down operation, and accordingly, the air temperature in the inner duct 12 is temporarily reduced. If heat generation by the defrosting heaters 22 were halted at this time, the temperature at the evaporator 13 would not be increased much, and incomplete defrosting would occur. As is described above, however, since the defrosting heaters 22 continue to generate heat, the air temperature in the inner duct 12, which is temporarily reduced at the start of the pumping down operation, rises again. As a result, the problem that arises when water remaining on the evaporator 13 is refrozen does not occur.

When the intake pressure of the compressor 43 is reduced, and the compressor 43 is halted by a low voltage switch (not shown), as is described above, the pumping down operation is terminated. Thereafter, when the air temperature of the inner duct 12 is increased to +10°0 C. by the heat generated by the defrosting heaters 22, based on the output of the defrost recovery temperature sensor 40, the controller halts the power supply to the defrosting heaters 22.

Since the drain pan heaters 19 generate heat during the dripping period, the refreezing of water on the drain pan 18 can be prevented. When the 6 minute dripping period has elapsed, the controller closes the solenoid valve SV6 and opens the solenoid valve SV5 to restart the above described cooling operation.

As is described above, the defrost recovery temperature sensor 54, for detecting the temperature at the outlet 36B of the evaporator 13, and the defrost recovery temperature sensor 40, for detecting the air temperature in the inner duct 12, are employed to independently control the time at which the supply to the evaporator 13 of gaseous refrigerant at a high temperature is halted, and the time at which the generation of heat by the defrosting heaters 22 is halted. Incomplete defrosting in the vicinity of the evaporator 13 is prevented, and compared with a conventional cooling device where defrosting heaters are conductive during a dripping period, the increase in the air temperature in the inner duct 12 can be controlled. Therefore, the minimum amount of heat is required for defrosting, and the temperature increase in the storage chamber 9 is reduced to the minimum.

The time at which defrosting using the high temperature refrigerant gas is terminated varies depending on seasonal changes in the ambient temperature of the condensing unit 41. Since the amount of heat generated by the defrosting heaters 22 is constant, an almost constant time can be set for halting the power supply to the defrosting heater 22 in accordance with the defrost recovery temperature sensor 40.

Figure 6:
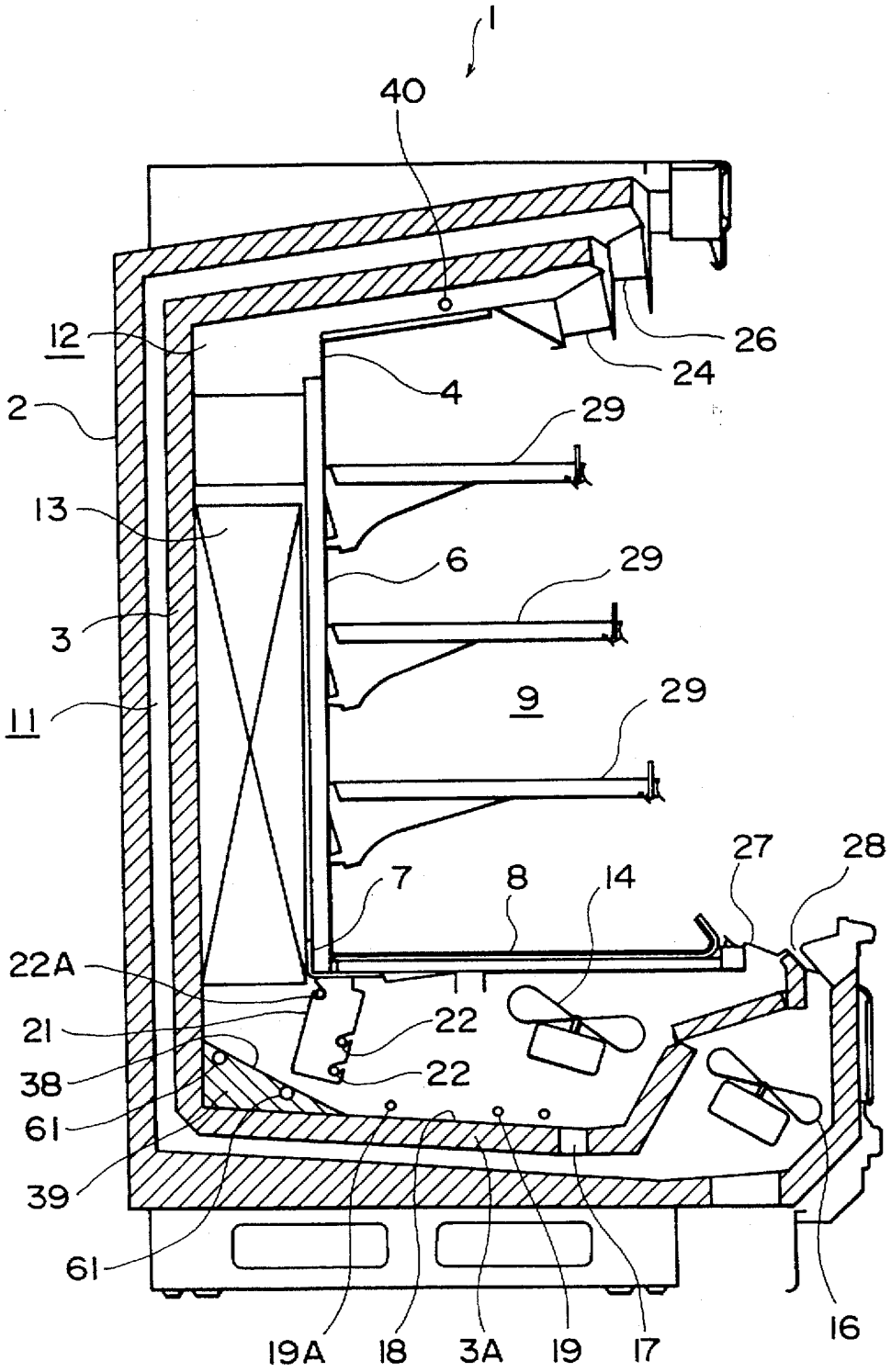
FIG. 6 is a vertical cross sectional side view of a low temperature display case according to another embodiment of the present invention.
Figure 7:
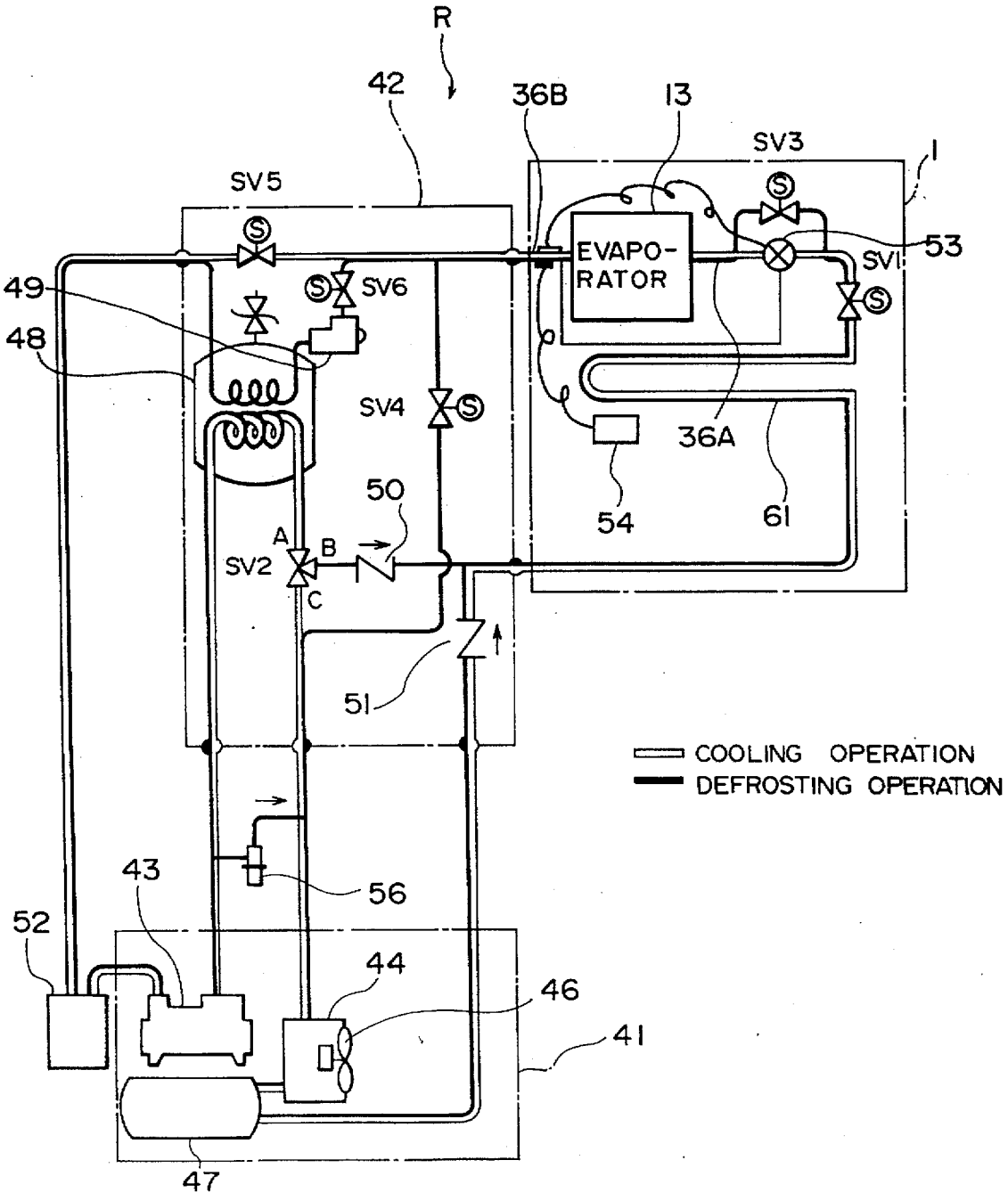
FIG. 7 is a refrigerant circuit diagram of a cooling device for cooling the low temperature display case shown in FIG. 6.
Figure 8:
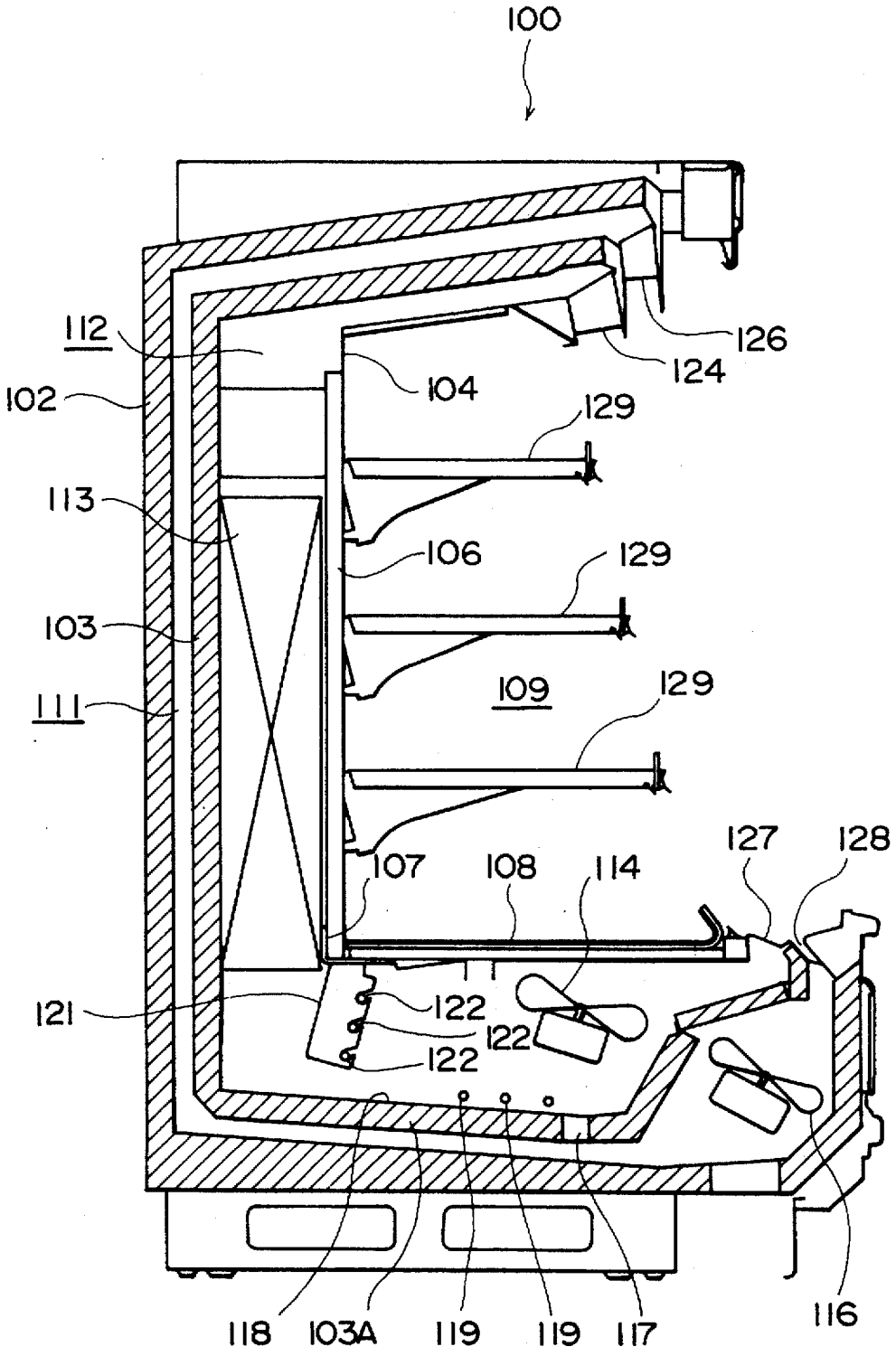
FIG. 8 is a vertical cross sectional side view of a conventional low temperature display case.

FIGS. 6 and 7 are refrigerant circuit diagrams for a low temperature display case and a cooling device R according to another embodiment. The same reference numerals as are used in FIGS. 1 through 5 are also used in FIGS. 6 and 7 to denote corresponding or identical components. In this embodiment, one part of a high pressure refrigerant pipe 60 that extends from a check valve 50 through a solenoid valve SV1 is employed as a drawing pipe 61, which is attached to the internal face of a slope member 38.

With this structure, since the slope member 38 is heated by refrigerant at a high temperature that flows through the drawing pipe 61, of the high pressure refrigerant pipe 60, frost will not build up on the surface of the slope member 38 during the cooling operation. During the defrosting operation, refreezing of water that falls from above can be more effectively prevented, and incomplete defrosting can be inhibited.

The slope member 38 need not be provided across the entire width of the inner duct 12. A great amount of heat is provided at an inlet 36A of an evaporator 13 because the inlet 36A is the point at which the refrigerant at a high temperature flows. The slope member 38 is not required in this portion. When the slope member 38 is not extended to the portion, the refrigerant inlet 36A and outlet 36B can be easily provided for the evaporator 13.

As is described above, according to the present invention, in a low temperature display case wherein a refrigerant at a high temperature is supplied to an evaporator, and defrosting heaters, which are located in a duct at a forward position that is not under the evaporator, generate heat to defrost the evaporator, a slope member (inclined portion) is so provided on a drain pan (on the inclined surface of the drain pan), at a position below the evaporator, that it is inclined toward a drain hole at a greater angle than is the drain pan. Water and ice that falls during the defrosting of the evaporator is smoothly discharged through the drain hole.

Contrary to a conventional device, the surface of the slope member is positioned near the defrosting heaters, and is strongly affected by the heat produced by them. Therefore, the refreezing of water on the drain pan under the evaporator can be prevented. According to the present invention, the water generated during defrosting can be fully discharged, and the degradation of the cooling ability due to residual frost can be prevented.

Since a pipe within which a high temperature refrigerant circulates is attached to the slope member, frost does not build up on the surface of the slope member during cooling. Also, during defrosting, the refreezing of water that falls from above can be effectively prevented, and incomplete frosting can be inhibited.

One part of the defrosting heaters is provided near the position where residual frost tends to accumulate. Since one of the defrosting heaters is provided near the metal fitting, as is described above, frost on the metal fitting can be completely thawed at a position that is less affected by heat from the high temperature refrigerant that flows through the evaporator. Incomplete frosting can thus be inhibited.

Since the tube sheets of the evaporator are formed of metal having highly thermal conductivity, the heat from the high temperature refrigerant that flows through the evaporator can be effectively transmitted to peripheral components that are fixed to the tube sheets. Incomplete frosting around the evaporator can thus be inhibited.

Further, since the metal fitting that is secured to the lower front end of the tube sheet of the evaporator is made of metal having highly thermal conductivity, the heat from the high temperature refrigerant that flows through the evaporator can be effectively transmitted to the metal fitting where frost tends to accumulate. Incomplete frosting around the evaporator can thus be inhibited.

In addition, since one of the defrosting heaters is located near the metal fitting, the heat produced by the defrosting heater can prevent the retention of residual frost on the metal fitting.

What is claimed is:

1. A low temperature display case comprising:

a duct formed in said case to communicate with a rear and a lower portion of a storage chamber having an opening at the front, an evaporator provided upright in said duct at a rear location of said storage chamber, the tube sheet of said evaporator being of a material having a high thermal conductivity and a metal strut fitting of high thermal conductivity fixed to the front lower end of said tube sheet of said evaporator, a blower for discharging from an upper edge of said opening of said storage chamber air that is cooled at said evaporator by heat exchange, a drain guide face located at a bottom level of said duct that is inclined downward toward a drain hole in said drain guide face;

defrosting heaters provided in a lower portion of said duct located forward of a position under said evaporator, and a sharply sloped portion provided on said drain guide face below said evaporator that is inclined at a greater angle toward said drain hole than is said drain guide face;

wherein to defrost said evaporator a refrigerant at a high temperature is fed into said evaporator and heat is generated by said defrosting heaters.

2. A low temperature display case according to claim 1, wherein a pipe along which said high temperature refrigerant circulates is attached to said sharply sloped portion.

3. A low temperature display case according to claim 1, wherein at least one of said defrosting heaters is located near said metal strut fitting.

4. A low temperature display case according to claim 1 wherein an attachment plate is provided inside said duct at the upper rear portion of said drain guide face, said defrosting heaters are mounted under said attachment plate located forward of a position under said evaporator to shield raised heaters from water dripping from said evaporator and at least one of said defrosting heaters is located near said metal strut fitting.

* * * * *